US007473045B2

(12) United States Patent
Dumler

(10) Patent No.: US 7,473,045 B2
(45) Date of Patent: Jan. 6, 2009

(54) COSMETIC UNIT

(75) Inventor: Norbert Dumler, Ansbach (DE)

(73) Assignee: Geka Brush GmbH, Bechhdfen-Watzendorf (DE)

( * ) Notice: Subject to any disclaimer, the term of this patent is extended or adjusted under 35 U.S.C. 154(b) by 0 days.

(21) Appl. No.: 11/636,532

(22) Filed: Dec. 11, 2006

(65) Prior Publication Data

US 2007/0166094 A1 Jul. 19, 2007

(30) Foreign Application Priority Data

Jan. 18, 2006 (EP) ..... 06000974

(51) Int. Cl.
*B05C 1/00* (2006.01)

(52) U.S. Cl. ..... 401/17; 401/18; 401/25

(58) Field of Classification Search ..... 401/17, 401/18, 25; 132/317; 206/581, 515
See application file for complete search history.

(56) References Cited

U.S. PATENT DOCUMENTS

| | | | | |
|---|---|---|---|---|
| 3,690,777 | A * | 9/1972 | Costa | 401/17 |
| 5,509,742 | A | 4/1996 | Balzarini | |
| 6,612,764 | B2 * | 9/2003 | Dumler et al. | 401/18 |
| 6,655,391 | B2 * | 12/2003 | Sunago | 401/17 |
| 6,682,242 | B1 * | 1/2004 | Montoli | 401/18 |
| 6,702,494 | B2 * | 3/2004 | Dumler et al. | 401/17 |
| 2002/0018688 | A1 * | 2/2002 | Dumler et al. | 401/17 |
| 2003/0053839 | A1 | 3/2003 | Dumler et al. | |
| 2003/0185616 | A1 | 10/2003 | Dumler et al. | |
| 2005/0019084 | A1 * | 1/2005 | Gueret | 401/25 |

FOREIGN PATENT DOCUMENTS

| | | | |
|---|---|---|---|
| DE | 197 3 290 | A1 | 2/1999 |
| DE | 100 39 490 | A1 | 2/2002 |
| DE | 102 13 643 | A1 | 10/2003 |
| GB | 123639 | | 3/1919 |

* cited by examiner

*Primary Examiner*—Khoa D Huynh
(74) *Attorney, Agent, or Firm*—Browdy and Neimark, P.L.L.C.

(57) ABSTRACT

In a cosmetic unit comprising two applicators, each having a stem, each of the applicators dipping into a respective reservoir, each reservoir having a reservoir neck provided with an external thread on which to screw a respective coupling part, and the two reservoirs being releasably attachable to each other by means of the screwed-on coupling parts, which at the same time serve as a closing cap, via a coupling sleeve by means of a snap-type connection, provision is made for the snap-type connection to comprise a locking bead disposed on the inside of the coupling sleeve in the outer end region of the coupling sleeve.

12 Claims, 4 Drawing Sheets

COSMETIC UNIT

BACKGROUND OF THE INVENTION

1. Field of the Invention

The invention relates to a cosmetic unit comprising two applicators, each having a stem, each of the applicators dipping into a respective reservoir, each reservoir having a reservoir neck provided with an external thread on which to screw a respective coupling part, and the two reservoirs being releasably attachable to each other by means of the screwed-on coupling parts, which at the same time serve as a closing cap, via a coupling sleeve by means of a snap-type connection.

2. Background Art

A cosmetic unit of this type is known from DE 102 13 643 A1. The known cosmetic unit has proven very successful in practice. It makes it possible to make two different applicators and/or cosmetic products available for application in one and the same unit. On one hand, the central coupling sleeve serves to connect the two reservoirs for the cosmetic products. On the other hand it forms a decorative surface, which significantly adds to the appearance of the unit as a whole.

Comparable cosmetic units are also known from DE 100 39 490 A1, DE 197 33 290 A1, U.S. Pat. No. 5,509,742 B1, GB 123 639 A1, and U.S. Pat. No. 3,690,777.

SUMMARY OF THE INVENTION

In units of this type, the problem arises that in the region where the wall of the coupling sleeve, which is injection-molded from plastic, has a greater thickness, outwardly obvious surface wavinesses are visible due to the injection molding process, which are perceived as esthetically disturbing.

With this as the starting point, the invention is based on the object of improving the outer appearance of a known cosmetic unit of this type while preserving its advantages with respect to its production and handling.

This object is met according to the invention in such a way that the snap-type connection comprises a locking bead on the inside of the coupling sleeve, said locking bead being arranged in the outer end region of the coupling sleeve.

A cosmetic unit of this type allows cosmetic products to be filled by conventional machines and also provides the consumer with the option to use the two units individually, or to combine them to her personal liking at the time of purchase to suit her personal desires and needs.

Moreover, however, according to the invention, this surprisingly results in the particularly obvious central region of the coupling sleeve being completely free of surface wavinesses on the outside, with the provision of the locking beads in the frontal edge region greatly reducing the occurrence of surface wavinesses in that region, or at least rendering them visually far less prominent.

Provision is advantageously made for the locking bead to be disposed less than 5 mm from the respective front end of the coupling sleeve.

In a preferred embodiment, the locking bead in the engaged condition may overlap the respective front end of the coupling sleeve and correspondingly snap in there, so that a separate locking groove to correspond with the locking bead is not required.

In another embodiment, the locking bead cooperates with a corresponding locking groove of the respective coupling part.

In this embodiment the locking bead may have an end region that is beveled in the insertion and snap-in direction to facilitate the insertion and snap-in process, whereas against the insertion direction, a section may be provided that extends by approximately 90° against the longitudinal axis of the coupling sleeve to increase the locking strength in the engaged condition.

The invention will be explained in more detail below based on a preferred embodiment in conjunction with the drawing.

DESCRIPTION OF THE PREFERRED EMBODIMENT

Figure 1:
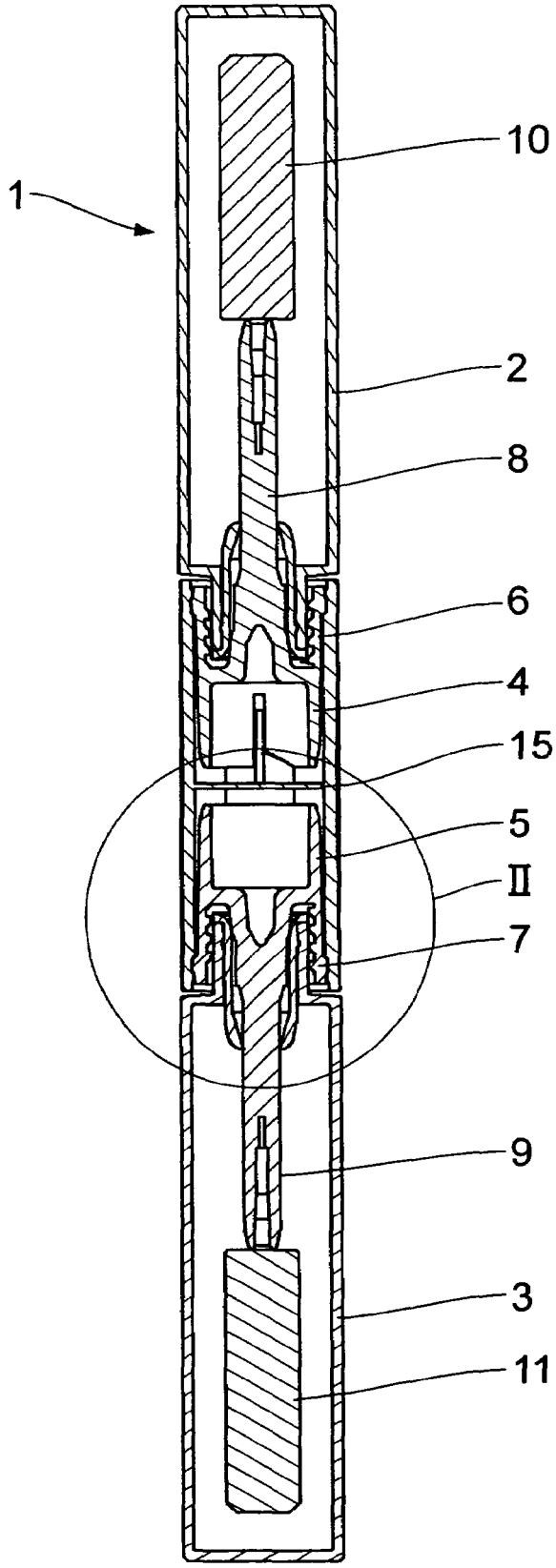
FIG. 1 shows a first example embodiment of an inventive cosmetic unit in a section.

A cosmetic unit 1 shown in the drawing comprises two reservoirs 2, 3, each for a cosmetic product, for example mascara, also two coupling parts 4, 5, each coupling part having a cup-like section 6, 7, and extending away from the cup bottom, a stem 8, 9 respectively formed as a unit with the coupling parts 4, 5 and provided at its respective distal end with an applicator 10, 11. Since the coupling parts 4, 5 are designed identical, only the region shown as the lower region in FIG. 1, marked with II, will be described in more detail below.

Figure 2:
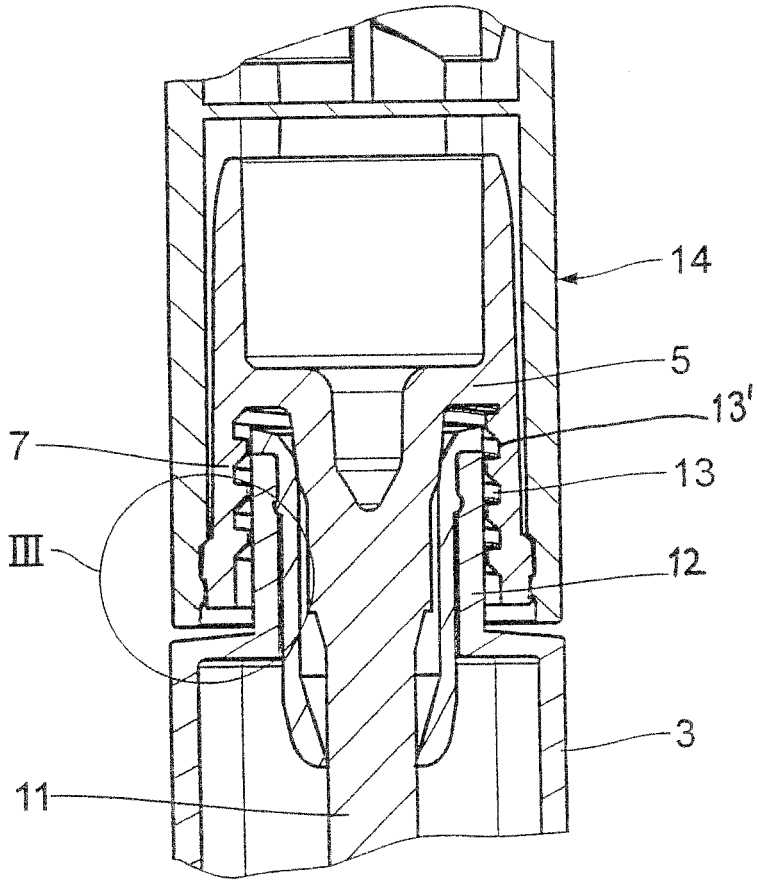
FIG. 2 shows the detail II in FIG. 1.

From FIG. 2 it can be seen that the reservoir 3 has a reservoir neck 12 provided with an external thread 13. The coupling part 5 has at its cup-like section 7 an inside thread 13' that corresponds with the thread 13, so that the coupling part 5 at the same time serves as a closing means for the reservoir 3.

The coupling part 5 engages into a coupling sleeve 14, which has a transversely extending dividing bottom 15 located between opposite ends of the coupling sleeve, as shown in FIG. 1 and which is constructed mirror-symmetrical relative to the same.

Figure 3:
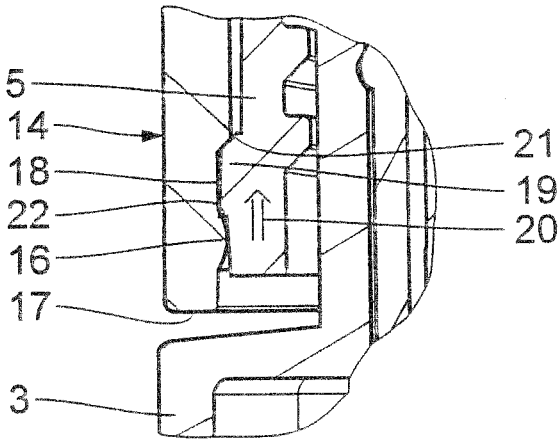
FIG. 3 shows the detail III in FIG. 2.

FIG. 3 illustrates that the coupling sleeve 14 has a "protruding" locking bead 16 around an inside circumference of the coupling s1eeve 14. Adjoining the same in the direction away from the front end 17 of the coupling sleeve 14 is a locking groove 18, into which a circumferential locking bead 19 of the coupling part 5 can be snapped in. The locking bead 19 has a beveled region 21 located in front in the locking direction (arrow 20), and at the rear, in the locking direction, a region 22 extending substantially perpendicular to the longitudinal axis of the coupling sleeve 14. This facilitates the snap-in process and increases the locking strength.

Figure 4:
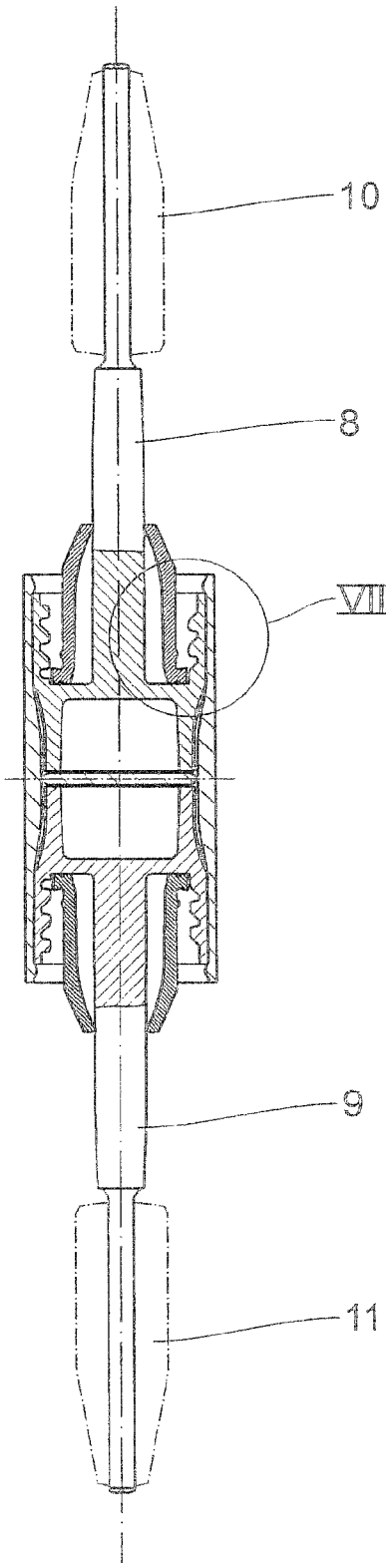
FIG. 4 shows a section through a second embodiment of an inventive cosmetic unit with attached reservoirs.
Figure 5:
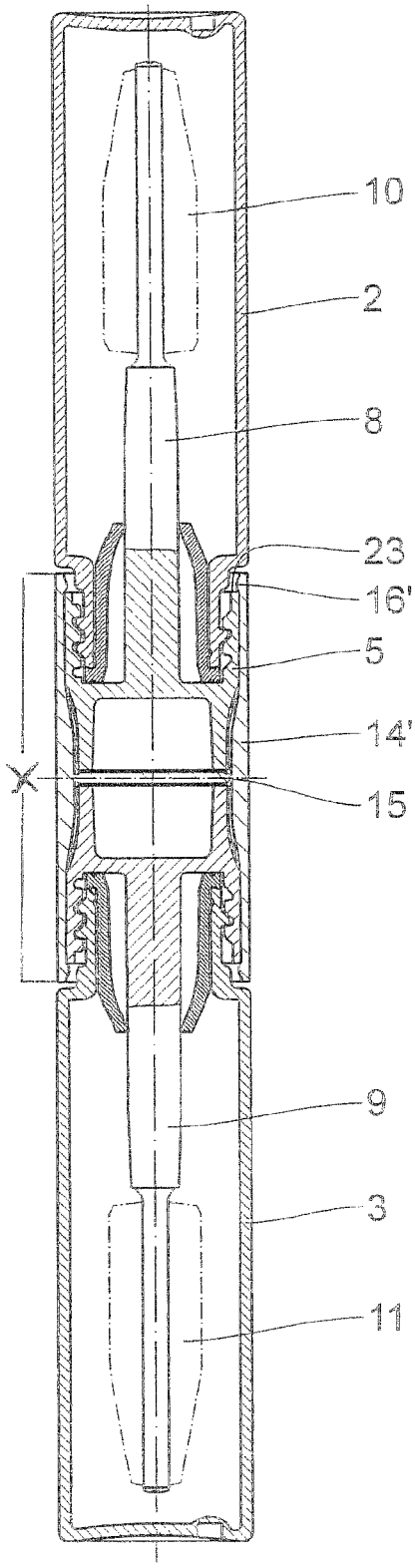
FIG. 5 shows a view corresponding to FIG. 4, without reservoirs.
Figure 6:
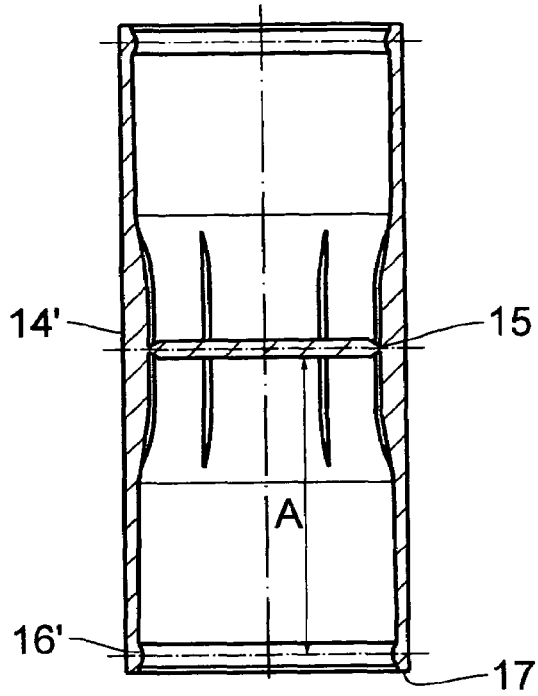
FIG. 6 shows an enlarged sectional view of the coupling sleeve.

The embodiment depicted in FIGS. 4 through 6 has the same basic structure as the embodiment according to FIG. 1 through 3, so that, in this context, reference can be made to the above description.

Figure 7:
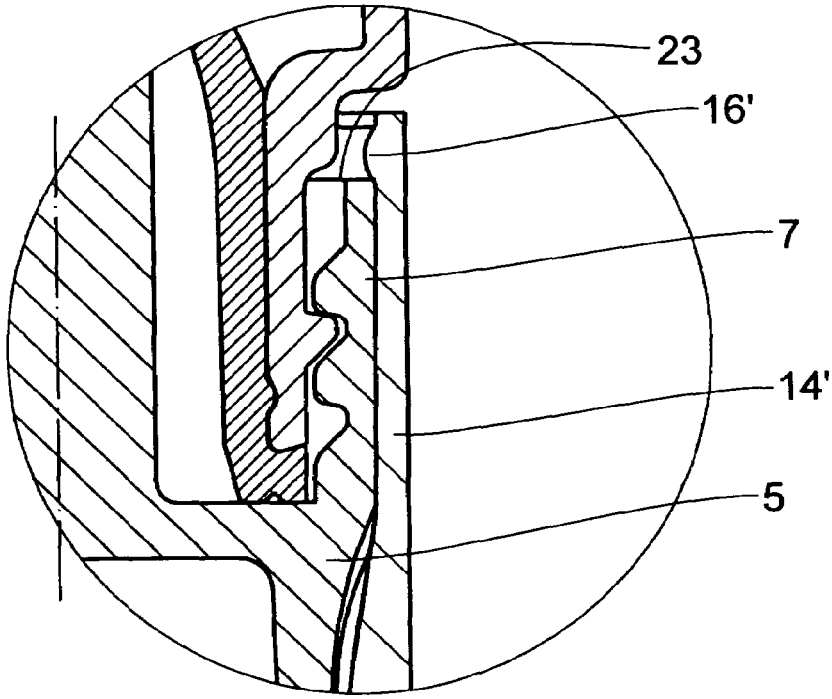
FIG. 7 shows the detail VII in FIG. 4.

Only the coupling sleeve 14' has been modified from the above-described embodiment in such a way that the locking bead 16' is formed directly at and over the front end 17 of the coupling sleeve 14' as shown in FIGS. 4, 5 and 7, and the distance A between the top surface of the dividing bottom 15 and apex region of the locking bead 16' is dimensioned such that when a coupling part 4, 5 snaps in, it moves to an end stop against the dividing bottom 15 on one hand, and the locking bead 16' simultaneously snaps in over the front end 23 of the coupling part 4, 5. This results in the connection of coupling parts 4, 5 and coupling sleeve 14' together along with the longitudinal lengths of the engaged parts 4, 5 and coupling sleeve 14', as shown in FIG. 2, and eliminating the need for a separate locking groove 18 on the respective coupling part 4, 5 and deterring axial movement between the coupling parts and the coupling sleeve as in all the embodiments.

What is claimed is:

1. A cosmetic unit comprising two applicators, each having a stem, each of the applicators dipping into a respective reservoir, each reservoir (2, 3) having a reservoir neck (12) provided with an external thread (13) on which to screw a respective coupling part (4, 5), and the two reservoirs (2, 3) being releasably attachable to each other by means of the screwed-on coupling parts, which at the same time serve as a closing cap, by a coupling sleeve (14,14') formed as a unit by means of a snap-type connection, wherein the snap-type connection includes a pair of first locking beads (16, 16') respectively disposed around the inside circumference of the coupling sleeve (14, 14') at opposite free ends of the coupling sleeve (14, 14') and respectively engaged on the coupling part (4,5) to deter axial movement between the coupling parts (4,5) and the coupling sleeve (14,14'), wherein each coupling parts (4,5) has a second locking bead (19) disposed around an outside circumference of each of said coupling parts (4,5) and the coupling sleeve (14) has a pair of locking grooves (18) disposed around an inside circumference of the coupling sleeve, each of said pair of locking grooves adjoin the respective first locking bead (16) in the direction away from a respective free end (17) of the coupling sleeve (14) wherein the second locking bead (19) cooperates and engages with the corresponding respective locking groove (18) of the coupling sleeve (14).

2. A cosmetic unit according to claim 1, wherein the first locking bead (16, 16') is disposed less than 5 mm from the respective free end (17) of the coupling sleeve (14, 14').

3. A cosmetic unit according to claim 1, wherein the second locking bead (19) has a side (21) that is beveled in the insertion and snap-in direction (arrow 20).

4. A cosmetic unit according to claim 1, wherein the second locking bead (19) has, against the insertion direction (arrow 20), a side (22) extending by approximately 90° relative to the longitudinal axis of the coupling sleeve (14).

5. A cosmetic unit according to claim 1, wherein the coupling part (4, 5) has a thread corresponding to the external thread of the reservoir neck (12) whose pitch is between 1.0 and 8 mm.

6. A cosmetic unit according to claim 1, wherein the stem 8 is formed as a unit with the coupling part (4,5) and has a diameter between 1.5 and 15.0 mm.

7. A cosmetic unit according to claim 1, wherein the coupling sleeve (14, l4') has a transversely extending dividing bottom (15) located between opposite free ends (17) of the coupling sleeve (14, 14').

8. A cosmetic unit comprising two applicators, each having a stem, each of the applicators dipping into a respective reservoir, each reservoir (2, 3) having a reservoir neck (12) provided with an external thread (13) on which to screw a respective coupling part (4, 5), and the two reservoirs (2, 3) being releasably attachable to each other by means of the screwed-on coupling parts, which at the same time serve as a closing cap, by a coupling sleeve (14,14') formed as a unit by means of a snap-type connection, wherein the snap-type connection includes a pair of first locking beads (16, 16') respectively disposed around the inside circumference of the coupling sleeve (14, 14') at opposite free ends of the coupling sleeve (14, 14') and respectively engaged on the coupling part (4,5) to deter axial movement between the coupling parts (4,5) and the coupling sleeve (14,14'), wherein each of said coupling part (4, 5) in the engaged condition has a bottom end which is parallel and adjacent to one another and a free end (23) disposed opposite said bottom end, wherein each of the first pair of locking beads (16') is located on the inside circumference directly at a free end (17) of the coupling sleeve (14'), wherein in a locking position, said first pair of locking beads (16') extend over and engage an outer surface of said respective free end (23) of the coupling part (4, 5) to connect the coupling parts (4, 5) and coupling sleeve (14') together along a longitudinal length thereof.

9. A cosmetic unit according to claim 8, wherein the first locking bead (16, 16') is disposed less than 5mm from the respective free end (17) of the coupling sleeve (14, 14').

10. A cosmetic unit according to claim 8, wherein the coupling part (4, 5) has a thread corresponding to the external thread of the reservoir neck (12) whose pitch is between 1.0 and 8 mm.

11. A cosmetic unit according to claim 8, wherein the stem (8) is formed as a unit with the coupling part (4,5) and has a diameter between 1.5 and 15.0 mm.

12. A cosmetic unit according to claim 8, wherein the coupling sleeve (14, 14') has a transversely extending dividing bottom (15) located between opposite free ends (17) of the coupling sleeve (14, 14').

* * * * *